US007813677B2

(12) United States Patent
Itabashi

(10) Patent No.: US 7,813,677 B2
(45) Date of Patent: Oct. 12, 2010

(54) PROCESS CARTRIDGE HAVING CHARGING DEVICE WITH CONDUCTIVE GRID ELECTRODE

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/267,670

(22) Filed: Nov. 10, 2008

(65) Prior Publication Data

US 2009/0074451 A1 Mar. 19, 2009

Related U.S. Application Data

(62) Division of application No. 11/188,730, filed on Jul. 26, 2005, now Pat. No. 7,463,850.

(30) Foreign Application Priority Data

Jul. 26, 2004 (JP) ..... 2004-217714

(51) Int. Cl.
*G03G 15/02* (2006.01)

(52) U.S. Cl. ..... 399/171

(58) Field of Classification Search ..... 399/171, 399/89, 170, 168, 115
See application file for complete search history.

(56) References Cited

U.S. PATENT DOCUMENTS 5,845,178 A 12/1998 Hazama et al.
6,735,407 B2 * 5/2004 Chavez et al. ..... 399/170
2003/0231901 A1 * 12/2003 Foltz ..... 399/171
2006/0153594 A1 * 7/2006 Yoshiyama ..... 399/171

FOREIGN PATENT DOCUMENTS

| | | | |
|---|---|---|---|
| JP | 59-046660 A | | 3/1984 |
| JP | 59-148071 A | | 8/1984 |
| JP | 4-156480 A | | 5/1992 |
| JP | 04178673 A | * | 6/1992 |
| JP | 4-330469 A | | 11/1992 |
| JP | 9-134057 A | | 5/1997 |
| JP | 9-244351 A | | 9/1997 |
| JP | 9-311524 A | | 12/1997 |

OTHER PUBLICATIONS

Computer translation of JP09-311524A ;Dec. 1997.

* cited by examiner

*Primary Examiner*—Quana M Grainger
(74) *Attorney, Agent, or Firm*—Banner & Witcoff, Ltd.

(57) ABSTRACT

A charger of a process cartridge may be configured so that a charging wire is laid across an upper frame. An upper frame may be provided with a stopper at which one end of the charging wire is caught, and with a wire pulling member that pulls the charging wire at the other end. The wire pulling member may include a coil spring portion and an engaging portion capable of engaging with the other end of the charging wire, so that the engaging portion may rotate on a centerline of the coil spring portion. The wire pulling member may be held in the upper frame so that the centerline of the coil spring portion may be substantially perpendicular to a longitudinal direction of an extended portion of the charging wire.

13 Claims, 13 Drawing Sheets

PROCESS CARTRIDGE HAVING CHARGING DEVICE WITH CONDUCTIVE GRID ELECTRODE

CROSS-REFERENCE TO RELATED APPLICATION

This application is a divisional application of U.S. application Ser. No. 11/188,730, filed Jul. 26, 2005, which claims priority from Japanese Patent Application No. 2004-217714, filed Jul. 26, 2004, the entire subject matter of which is incorporated herein by reference.

BACKGROUND

The invention relates to a process cartridge that is capable of being used with an image forming apparatus.

As a charger of a conventional image forming apparatus, a scorotron charger as disclosed in Japanese Patent No. 3198917 is used. This charger is structured such that a charging wire is laid across the frame to perform corona discharge between the wire and an electrode plate and to charge a photosensitive member using positive or negative ions created by the corona discharge.

Recently, a size reduction of the image forming apparatus has be en demanded. Thus, for a smaller-size image forming apparatus, a size reduction of the charger is also required. However, Japanese Patent No. 3198917 does not disclose any technology to reduce the size of the charger. In Japanese Patent No. 3198917, a longitudinal direction of a tense portion of the charging wire is parallel to a direction of a centerline of a coil spring portion. Thus, if a stable tension is given to the charging wire, the number of turns of the coil spring portion may increase, the length in the longitudinal direction may become longer, and a structure will be unfit for reducing the size of the charger or the image forming apparatus.

SUMMARY

The invention provides a structure capable of contributing to a smaller size of a charging device and an image forming apparatus.

According to one aspect of the invention, a process cartridge, which is detachably attachable to a main body of an image forming apparatus, may include a photosensitive member and a charging device capable of charging the photosensitive member. The charging device may include a charging wire; a frame including a wire supporting wall capable of stretching taut and supporting the charging wire and a stopper that stops a first end of the charging wire; and a wire pulling member that is held in the frame, the wire pulling member including a coil spring portion that is helically structured and an engaging portion that is provided at an end portion of the coil spring portion and capable of engaging with a second end of the charging wire. The wire pulling member may be held in the frame in a manner that a coil centerline of the coil spring portion is substantially perpendicular to a longitudinal direction of an extended portion of the charging wire stretched by the wire supporting wall.

BRIEF DESCRIPTION OF THE DRAWINGS

An illustrative embodiment of the invention will be described in detail with reference to the following figures wherein.

DETAILED DESCRIPTION

An illustrative embodiment of the invention will be described in detail with reference to the accompanying drawings. An overall construction will be described with reference to FIGS. 1 through 5.

Figure 1:
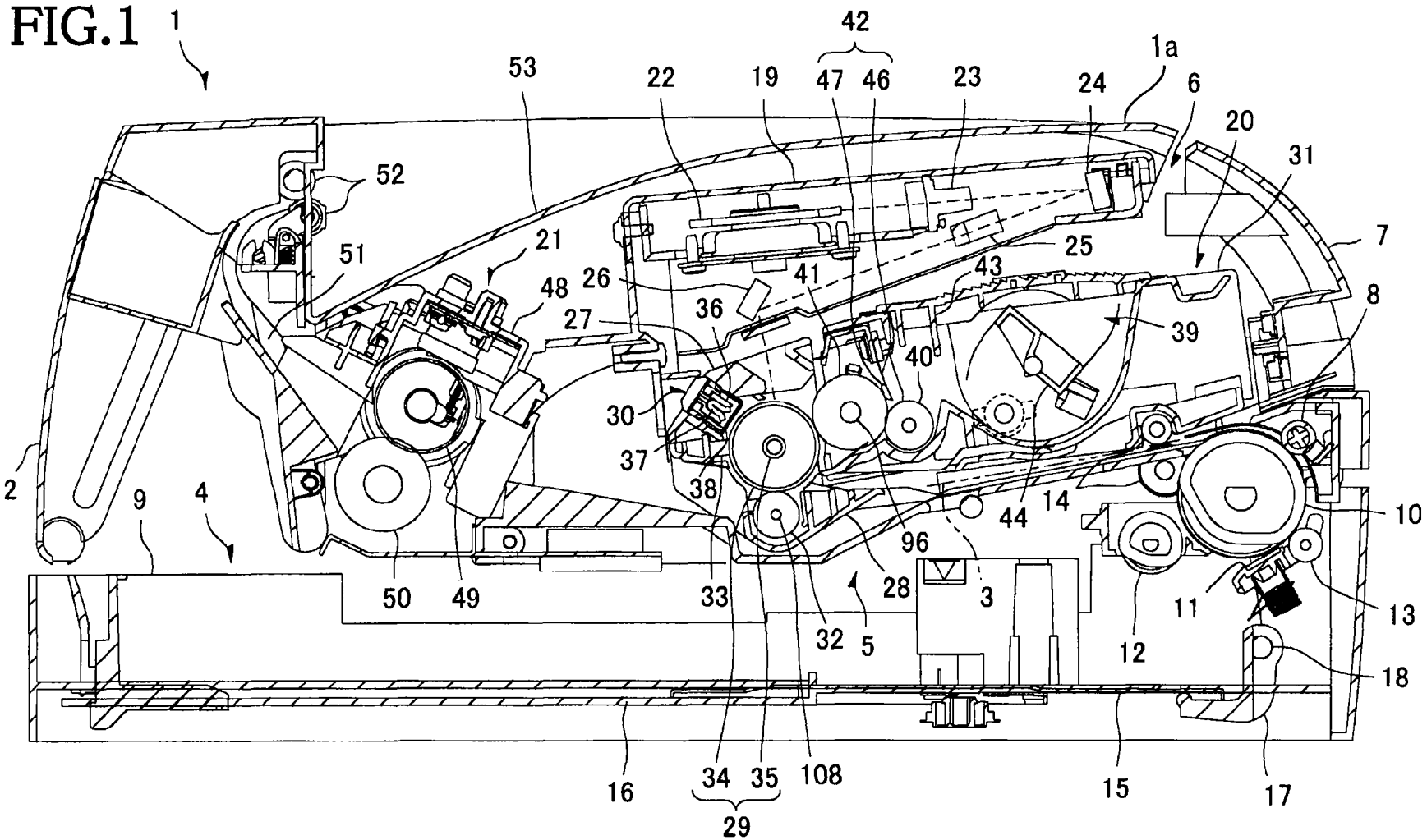
FIG. 1 is a sectional view of the parts of a laser printer as an image forming apparatus of an illustrative embodiment of the invention when a front cover is closed.
Figure 2:
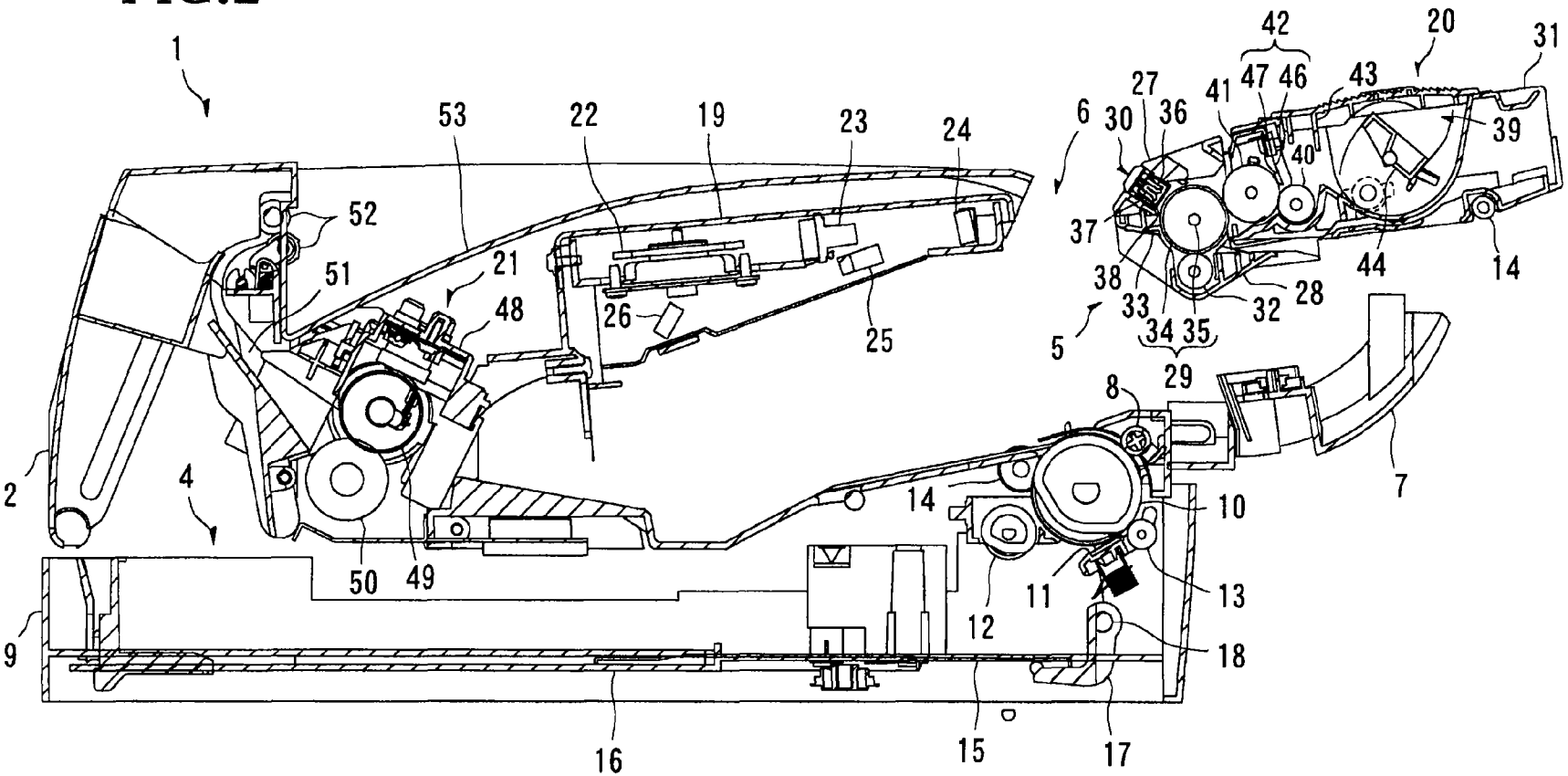
FIG. 2 is a sectional view of the parts of the laser printer shown in FIG. 1 when the front cover is open.

As shown in FIGS. 1 and 2, a laser printer 1 includes, in a main casing 2, a feeder unit 4 that supplies a sheet 3 as a transfer medium, and an image forming part 5 that forms an image on a sheet 3 supplied therein.

The main casing 2 is formed, at one side wall, with an opening 6 through which a process cartridge 20 is inserted in or removed from the main casing 2, and is provided with a front cover 7 capable of opening and closing. The front cover 7 is pivotally supported by a cover shaft (not shown), which is inserted into the front cover 7 at a lower end portion thereof. When the front cover 7 is closed around the cover shaft, the opening 6 is closed by the front cover 7 as shown in FIG. 1. When the front cover 7 is opened (tilted) around the cover shaft, the opening 6 is opened by the front cover 7 as shown in FIG. 2, so that the process cartridge 20 can be inserted into or removed from an apparatus body 1*a* via the opening 6. In the laser printer 1, a part except for the process cartridge 20 is referred to as the apparatus body 1*a*.

In the following description, the side on which the front cover 7 is provided will be referred to as a front side, and the side opposite to the front side will be referred to as a rear side.

The feeder unit 4 includes, at a bottom portion in the main casing 2, a sheet supply tray 9, a sheet supply roller 10, a separation pad 11, a pickup roller 12, a pinch roller 13, a paper dust removing roller 8, and register rollers 14. The sheet supply tray 9 is removably attachable. The sheet supply roller 10 and the separation pad 11 are provided at an upper portion of the front end portion of the sheet supply tray 9. The pickup roller 12 is provided behind the sheet supply roller 10. The pinch roller 13 is disposed facing the sheet supply roller 10 at a lower front side thereof. The paper dust removing roller 8 is disposed facing the sheet supply roller 10 at an upper front side thereof. The register rollers 14 are provided at an upper rear side of the sheet supply roller 10.

Inside the sheet supply tray 9, there is provided a sheet pressing plate 15 capable of holding sheets 3 in layers. The sheet pressing plate 15 is pivotally supported at its rear end. The sheet pressing plate 15 is vertically movable at its front end between a loading position and a conveying position. When in the loading position, the sheet pressing plate 15 is disposed such that its front end is positioned down and aligned with a bottom plate 16 of the sheet supply tray 9. When in the conveying position, the sheet pressing plate 15 is disposed such that its front end is inclined upward.

A lever 17 for raising the front end of the sheet pressing plate 15 is provided at a front end portion of the sheet supply tray 9. The lever 17 is formed in such a substantially L-shape in a sectional view that extends from the front side of the sheet pressing plate 15 to the underside thereof. The lever 17 is attached, at its upper end, to a lever shaft 18 provided at the front end portion of the sheet supply tray 9, and makes contact with the underside of the front end of the sheet pressing plate 15 at its rear end. When a clockwise (with respect to the drawing) rotation force is transmitted to the lever shaft 18, the lever 17 is rotated around the lever shaft 18 to raise the front end of the sheet pressing plate 15 by its rear end to the conveying position.

When the sheet pressing plate 15 is located to the conveying position, a sheet 3 on the sheet pressing plate 15 is pressed by the pickup roller 12, and is conveyed between the sheet supply roller 10 and the separation pad 11 upon rotation of the pickup roller 12.

On the other hand, when the sheet supply tray 9 is removed from the main casing 2, the sheet pressing plate 15 is moved down at its front end portion by its weight, and is located in the loading position. When the sheet pressing plate 15 is located in the loading position, it is capable of loading sheets 3 on the sheet pressing plate 15 in layers.

An uppermost sheet 3 is forwarded by the pickup roller 12 toward the sheet supply roller 10 and the separation pad 11. Each of the sheets 3 is sandwiched between the sheet supply roller 10 and the separation pad 11 upon the rotation of the sheet supply roller 10, and is then reliably supplied, one by one, separately from the stack of the sheets 3. The supplied sheet 3 passes between the sheet supply roller 10 and the pinch roller 13, where paper dust is removed by the paper dust removing roller 8, and is conveyed to the register rollers 14.

The register rollers 14 are paired and designed to feed a sheet 3 to a transfer position between a photosensitive drum 29 and the transfer roller 32, where a toner image on the photosensitive drum 29 is transferred onto the sheet 3.

The image forming part 5 includes a scanner unit 19, the process cartridge 20, and a fixing part 21.

The scanner unit 19 is disposed at an upper portion in the main casing 2. The scanner unit 19 includes a laser light source (not shown), a polygon mirror 22 that is rotatably driven, an fθ lens 23, a reflecting mirror 24, a lens 25, and a reflecting mirror 26. In the scanner unit 19, as shown in a chain line, a laser beam emitted from the laser light source, based on print data, is deflected by the polygon mirror 22, passes through the fθ lens 23, is folded by the reflecting mirror 24, passes through the lens 25, is bent downward by the reflecting mirror 26, and is then directed to a surface of a photosensitive drum 29 of the process cartridge 20.

Figure 4:
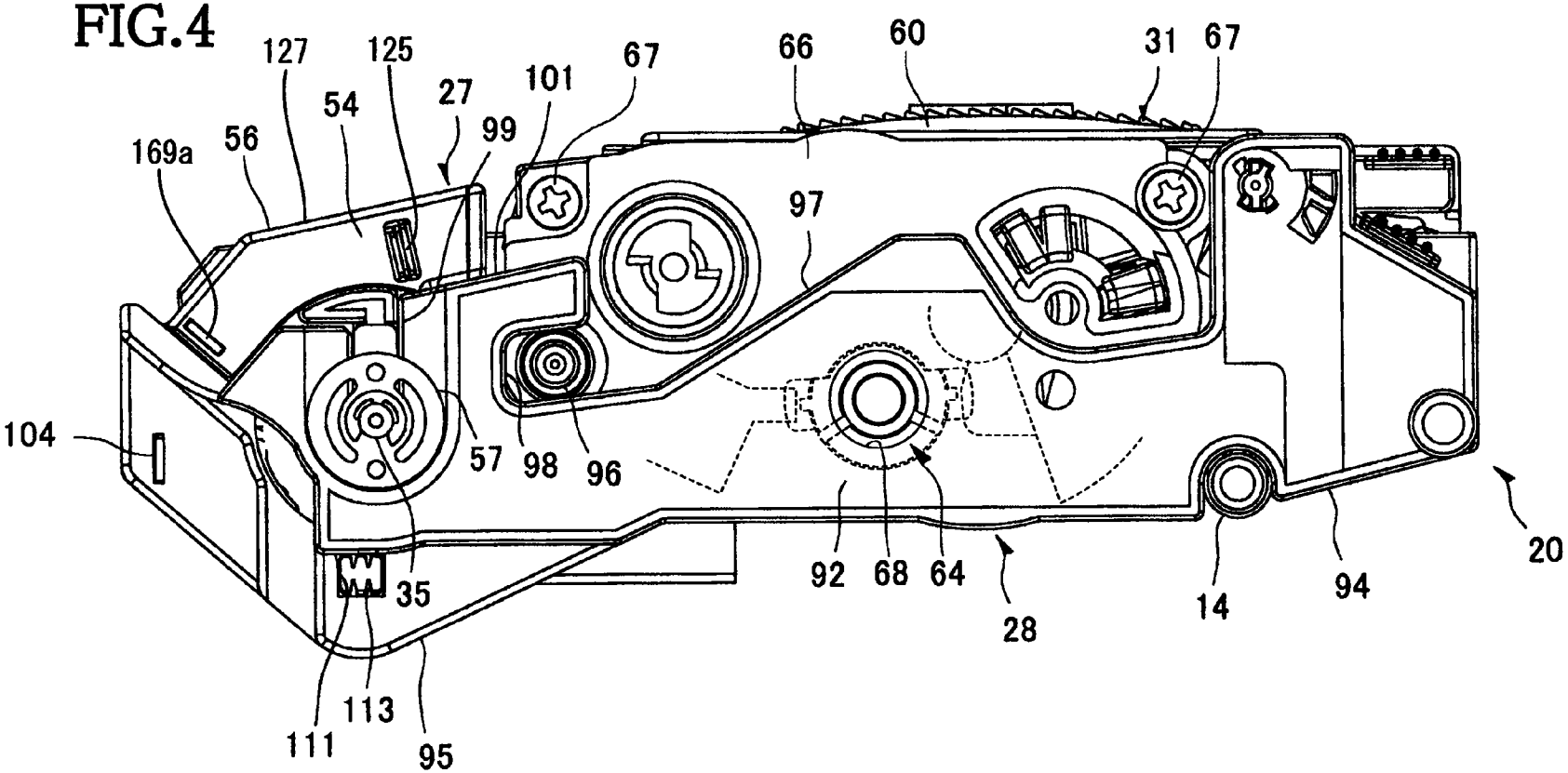
FIG. 4 is a side view of the process cartridge shown in FIG. 1.
Figure 5:
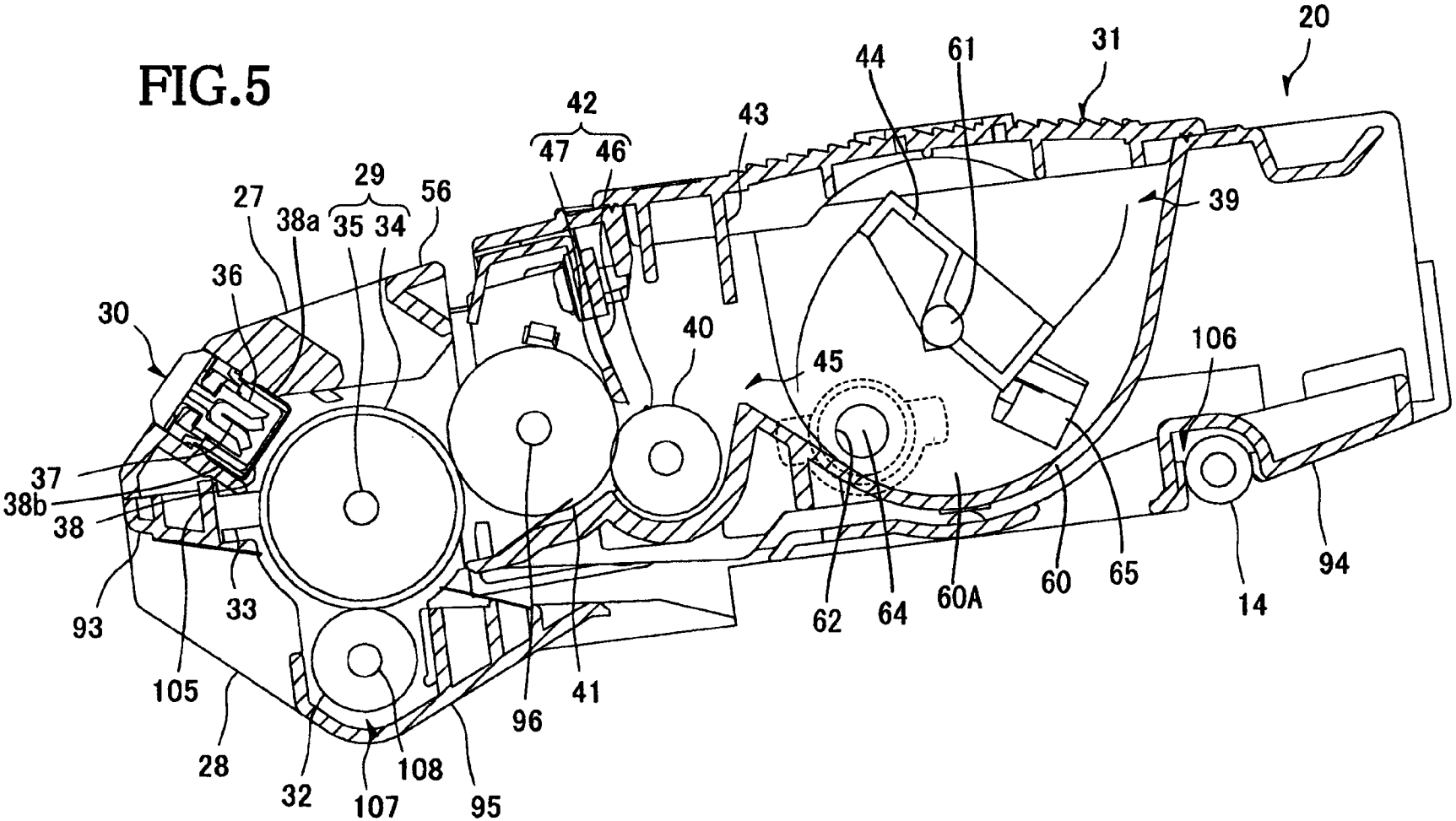
FIG. 5 is a sectional view taken along the line A-A of FIG. 3.

The process cartridge 20 is mounted to the main casing 2 below the scanner unit 19. The process cartridge 20 is provided with an upper frame 27 (functioning as a first frame) and a lower frame 28 (functioning as a second frame), which is provided separately to be assembled with the upper frame 27, as shown in FIG. 4. The process cartridge 20 includes the photosensitive drum 29 (functioning as an image holding member), a charger 30 (functioning as a charging device), a developing cartridge 31, a transfer roller 32 (functioning as a transfer device), and a cleaning brush 33, as shown in FIG. 5.

The photosensitive drum 29, having a cylindrical shape, is provided with a drum body 34, and a metallic drum shaft 35. The drum body 34 is formed such that its outermost layer is a positively charged photosensitive layer made of polycarbonate. The drum shaft 35 extends in a longitudinal direction of the drum body 34 at the center of axle of the drum body 34. The drum shaft 35 is supported by the upper frame 27, and the drum body 34 is rotatably supported by the drum shaft 35. With this structure, the photosensitive drum 29 is provided such as to rotate around the drum shaft 35 in the upper frame 27.

The charger 30 is comprised as a scorotron charger, and is disposed facing the photosensitive drum 29 at a specified distance so as not to contact the photosensitive drum 29. The charger 30 includes a charging wire 37 and a grid electrode 38. The charging wire 37 is disposed facing the photosensitive drum 29 at a specified distance in an axial direction thereof. The grid electrode 38 is provided between the charging wire 37 and the photosensitive drum 29 to control a discharge from the charging wire 37 to the photosensitive drum 29. In the scorotron charger 30, a bias voltage is applied to the grid electrode 38 as well as a high voltage is applied to the charging wire 37, so that a corona discharge is generated from the charging wire 37, and the surface of the photosensitive drum 29 is uniformly, positively charged. The concrete structure of the charger will be described later.

The scorotron charger 30 is provided with a cleaning member 36 for cleaning the charging wire 37, which is disposed so as to hold the charging wire 37.

The developing cartridge 31 includes an accommodating case 60 shaped in a box of which rear side is released. The developing cartridge 31 is detachably attached to the lower frame 28. In the developing cartridge 31, a toner chamber 39, a supply roller 40, a developing roller 41, and a layer-thickness regulating blade 42 are provided.

The toner chamber 39 is formed as an internal space at the front side of the accommodating case 60 partitioned by a partition plate 43. The toner chamber 39 contains positively charged nonmagnetic single-component toner as a developing agent. The toner used in this illustrative embodiment is a polymerized toner obtained through copolymerization of styrene-based monomers, such as styrene, and acryl-based monomers, such as acrylic acid, alkyl (C1-C4) acrylate, and alkyl (C1-C4) methacrylate, using a known polymerization method, such as suspension polymerization. The particle shape of such a polymerized toner is substantially spherical, and thus the polymerized toner has excellent flowability and contributes to high-quality image formation.

A coloring agent, such as carbon black, and wax are added to the polymerized toner. An external additive, such as silica, is also added to the polymerized toner to improve flowability. The average particle size of the toner is approximately 6-10 μm.

The toner chamber 39 is provided with an agitator 44, which is supported by a rotating shaft 61 provided in a center. The agitator 44 is rotatably driven upon an input of power from a motor (not shown). When the agitator 44 is rotatably driven, toner in the toner chamber 39 is agitated, and is discharged from an opening 45, which communicates front and rear portions under a partition plate 43, toward the supply roller 40.

On each of the right and left sidewalls 60A of the accommodating case 60, a window 62 for detecting a remaining toner is provided in an area corresponding to the toner chamber 39. The window 62 is covered with a window member 64 via a sealing member (not shown). Each window member 64 is cleaned by a wiper 65 held by and synchronized with the agitator 44. The main casing 2 is provided with a light emitting element (not shown) on the outside of one window 62 and a light receiving element (not shown) on the outside of the other window 62. Light, which is emitted from the light emitting element and passes through the accommodating case 60, is received by the light receiving element, so that the presence or absence of toner is detected in response to the output value.

The supply roller 40 is disposed at the rear side of the opening 45 and rotatably supported by the developing cartridge 31. The supply roller 40 is made by covering a metallic roller shaft with a roller made of a conductive foaming material. The supply roller 40 is rotatably driven by input of power from a motor (not shown).

Figure 3:
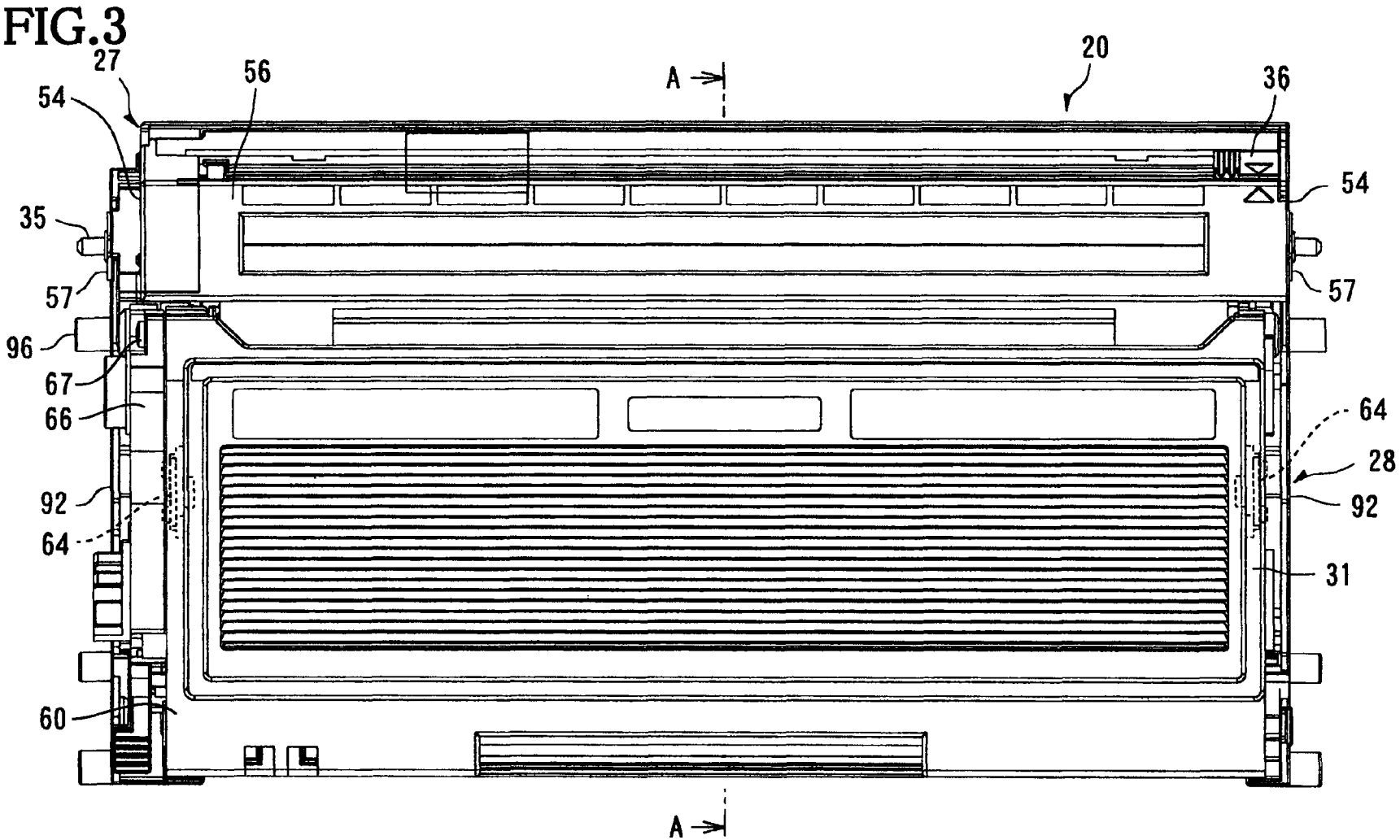
FIG. 3 is a plan view of a process cartridge shown in FIG. 1.

The developing roller 41 is rotatably supported by the developing cartridge 31 facing the supply roller 40, in such a manner as to press into contact with the supply roller 40 at the rear side of the supply roller 40. The developing roller 41 contacts the photosensitive drum 29 when the developing cartridge 31 is mounted in the lower frame 28. The developing roller 41 is made by covering a metallic roller shaft 96 with a roller made of conductive rubber material. Each end of the roller shaft 96 protrudes outward from each side of the developing cartridge 31 in a direction orthogonal to the front-rear direction (FIGS. 3 and 4). The developing roller 41 is made by covering a roller body made of a conductive urethane or silicone rubber, which includes carbon particles, with a coat layer made of urethane or silicone rubber, which includes fluorine. During developing, a developing bias is applied to the developing roller 41. The developing roller 41 is rotated in the same direction as the supply roller 40 by input of power from a motor (not shown).

The layer-thickness regulating blade 42 includes a blade body 46 made of a metallic leaf spring member and a pressing portion 47 having a generally semicircular shape in cross section, provided at a free end of the blade body 46, and made of insulative silicone rubber. The layer-thickness regulating blade 42 is supported by the developing cartridge 31 in an upper portion of the developing roller 41, and is pressed against the developing roller 41 by elastic force of the blade body 46.

Toner discharged from the opening 45 is supplied to the developing roller 41 through the rotation of the supply roller 40, while being positively and frictionally charged between the supply roller 40 and the developing roller 41. Toner supplied onto the developing roller 41 goes in between the pressing portion 47 of the layer-thickness regulating blade 42 and the developing roller 41. Along with the rotation of the developing roller 41, the toner is uniformly regulated to a specified thickness as a thin layer and carried on the developing roller 41.

On the left side surface of the accommodating case 60, a gear mechanism (not shown), for transmitting power from a motor (not shown) to each rotating shaft of the agitator 44, the supply roller 40 and the developing roller 41, is provided. Further, a cover 66 that covers the gear mechanism is secured by screws 67.

The transfer roller 32 is rotatably supported by the lower frame 28. With the upper frame 27 and the lower frame 28 assembled, the transfer roller 32 is disposed in order to face and contact the photosensitive drum 29 vertically and form a nip between the transfer roller 32 and the photosensitive drum 29. The transfer roller 32 is made by covering a metallic roller shaft 108 with a roller made of a conductive rubber material. During image transfer, a transfer bias is applied to the transfer roller 32. The transfer roller 32 is rotatably driven in an opposite direction to the photosensitive drum 29 by input of power from a motor (not shown).

The cleaning brush 33 is attached to the lower frame 28 and is disposed to contact the photosensitive drum 29 from the rear with the upper frame 27 and the lower frame 28 when assembled.

Along with the rotation of the photosensitive drum 29, the surface of the photosensitive drum 29 is uniformly, positively charged by the scorotron charger 30. Then, a laser beam from the scanner unit 19 is scanned at high speed on the surface of the photosensitive drum 29, so that an electrostatic latent image corresponding to an image to be formed on the sheet 3 is formed on the surface of the photosensitive drum 29.

With the rotation of the developing roller 41, toner carried on the developing roller 41 and positively charged makes contact with the photosensitive drum 29, and is supplied to the electrostatic latent image formed on the surface of the photosensitive drum 29. That is, the toner is supplied to an exposure portion of the uniformly, positively charged surface of the photosensitive drum 29, where the potential has become low due to exposure to the laser beam. As a result, the latent image on the photosensitive drum 29 is developed with the toner to form a visible image (toner image) and a reversal takes place. Thus, the toner image is formed on the photosensitive drum 29.

The toner image carried on the photosensitive drum 29 is transferred onto the sheet 3 by a transfer bias applied to the transfer roller 32 while the sheet 3, being conveyed by the register rollers 14, passes through a transfer position between the photosensitive drum 29 and the transfer roller 32 as shown in FIG. 1. The sheet 3 to which the toner image has been transferred is conveyed to the fixing part 21.

Toner remaining on the photosensitive drum 29 after toner transfer is collected by the developing roller 41. In addition, paper dust of the sheet 3 adhered on the photosensitive drum 29 after the toner transfer is collected by the cleaning brush 33.

The fixing part 21 is provided at the rear of the process cartridge 20, and includes a heat roller 49 and a pressure roller 50 in a fixing frame 48.

The heat roller 49 includes a metal tube coated with fluorine-base resin, and a halogen lamp for heating placed in the metal tube. The heat roller 49 is rotatably driven by an input of power from a motor (not shown).

The pressure roller 50 is disposed in a face-to-face relationship with the heat roller 49 so as to press against the heat roller 49 from underneath. The pressure roller 50 is made by covering a metallic roller shaft with a roller made of a rubber material. The pressure roller 50 is rotated along with the rotation of the heat roller 49.

At the fixing part 21, toner transferred onto the sheet 3 at the transfer position is fixed by heat while the sheet 3 passes between the heat roller 49 and the pressure roller 50. The sheet 3, where toner is fixed by heat, is conveyed to a sheet ejection path 51 that extends upward toward the top surface of the main casing 2. The sheet 3 conveyed to a sheet ejection path 51 is ejected by ejection rollers 52, disposed above the sheet ejection path 51, and is stacked on a sheet discharge tray 53 formed on the top surface of the main casing 2.

Process Cartridge (Overall Construction of the Process Cartridge)

FIG. 3 is a plan view of a process cartridge 20; FIG. 4 is a side view of the process cartridge 20; and FIG. 5 is a sectional view taken along the line A-A of FIG. 3.

The upper frame 27 integrally includes a pair of right and left sidewalls 54, and a top wall 56, and is open at its front and bottom as shown in FIG. 5. Bearing members 57 are attached to the drum shaft 35 of the photosensitive drum 29 at both ends, so that the drum shaft 35 is supported via the bearing members 57 between the sidewalls 54 of the upper frame 27.

The lower frame 28 integrally includes a pair of sidewalls 92 (FIG. 4), a rear connection portion 93, a lower front connection portion 94, and a lower rear connection portion 95 (FIG. 5) that all connect bottom edge portions of the sidewalls 92. The lower frame 28 is shaped so as to open upward.

As shown in FIG. 4, the pair of sidewalls 92 is disposed opposite to each other to sandwich the upper frame 27 and the developing cartridge 31 therebetween. Each sidewall 92 includes a roller shaft guiding portion 97, a roller shaft receiving portion 98, and a bearing member receiving groove 99. The roller shaft guiding portion 97 is used for guiding an end portion of a roller shaft 96 of the developing roller 41, which protrudes outward from the side surface of the developing cartridge 31 when the developing cartridge 31 is attached to or removed from the lower frame 28. The roller shaft receiving portion 98 is provided at a rear end of the roller shaft guiding portion 97 to receive the end portion of the roller shaft 96 guided by the roller shaft guiding portion 97. At a rear of the roller shaft receiving portion 98, the bearing member receiving groove 99 receives the bearing member 57 when the upper frame 27 is attached to or removed from the lower frame 28.

The roller shaft guiding portion 97 is formed as an upper edge of the each sidewall 92 at substantially a central portion with respect to the front-rear direction. The roller shaft guiding portion 97 extends obliquely downward from the front to the rear, and then extends substantially horizontally.

In each sidewall 92, the roller shaft receiving portion 98 is continuous with the rear side of the shaft guiding portion 97 and is formed in a substantially rectangular shape, in side view, so as to be recessed from a front end portion of a protrusion portion 101 that protrudes frontward at an upper portion of the roller shaft receiving portion 98.

A space further forward than the roller shaft receiving portion 98 is used for attaching the developing cartridge 31. Each end portion of the roller shaft 96, which protrudes from both sides of the developing cartridge 31, is guided by the roller shaft guiding portion 97, is moved toward the roller shaft receiving portion 98, and is received by the roller shaft receiving portion 98. Thus, the developing cartridge 31 is mounted in this space with the roller shaft 96 supported by the pair of the sidewalls 92.

When the developing cartridge 31 is mounted in the lower frame 28, both end portions of the roller shaft 96 are exposed outward from the sidewalls 92 (FIG. 3) via the roller shaft receiving portions 98. When the process cartridge 20 is mounted in the main casing 2, an electrode for applying a developing bias is connected to the left end portion of the roller shaft 96. In addition, each sidewall 92 is provided with a circular through hole 68 at a place corresponding to the window 62 of the accommodating case 60 when the developing cartridge 31 is mounted in the lower frame 28.

The bearing member receiving groove 99 is of substantially a U-shaped groove that vertically extends downward from the top end of the protrusion portion 101 of each sidewall 92 and is open at its top. The bearing member 57 is rotatably received at the bottom end portion of the bearing member receiving groove 99. In the process cartridge 20, the upper frame 27 is assembled to the lower frame 28 from above by inserting each bearing member 57 into the bearing member receiving groove 99.

The left sidewall 92 is formed with an opening 111 for exposing a transfer electrode 113 under the bearing member receiving groove 99.

Further, the left sidewall 92 is provided with a cleaning electrode 104 for applying a cleaning bias to the cleaning brush 33 at the rear of the bearing member receiving groove 99.

As shown in FIG. 5, the rear connection portion 93 connects the pair of sidewalls 92 at their rear end portions. The rear connection portion 93 is provided with a wall portion 105 that faces the photosensitive drum 29 at the rear thereof. The cleaning brush 33 is attached to the wall portion 105.

The lower front connection portion 94 connects the pair of sidewalls 92 at their lower front end portions. The lower front connection portion 94 includes a register roller accommodating portion 106 for accommodating the upper register roller 14.

The lower rear connection portion 95 connects the pair of sidewalls 92 at their lower rear end portions under the bearing member receiving groove 99, as shown in FIG. 4. The lower rear connection portion 95 includes a transfer roller accommodating portion 107 for accommodating the transfer roller 32, as shown in FIG. 5. In addition, the lower rear connection portion 95 is provided with roller bearings (not shown) at both end portions of the transfer roller accommodating portion 107 with respect to the longitudinal direction thereof. As both end portions of the roller shaft 108 are received by the roller bearings, the transfer roller 32 is rotatably supported by the lower rear connection portion 95.

The left end portion of the roller shaft 108 and the transfer electrode 113 for applying a transfer bias are disposed so as to contact each other. The transfer electrode 113 is exposed outward to the left via the opening 111 on the left sidewall 92.

(Charger)

The structure of the charger will be described.

Figure 6:
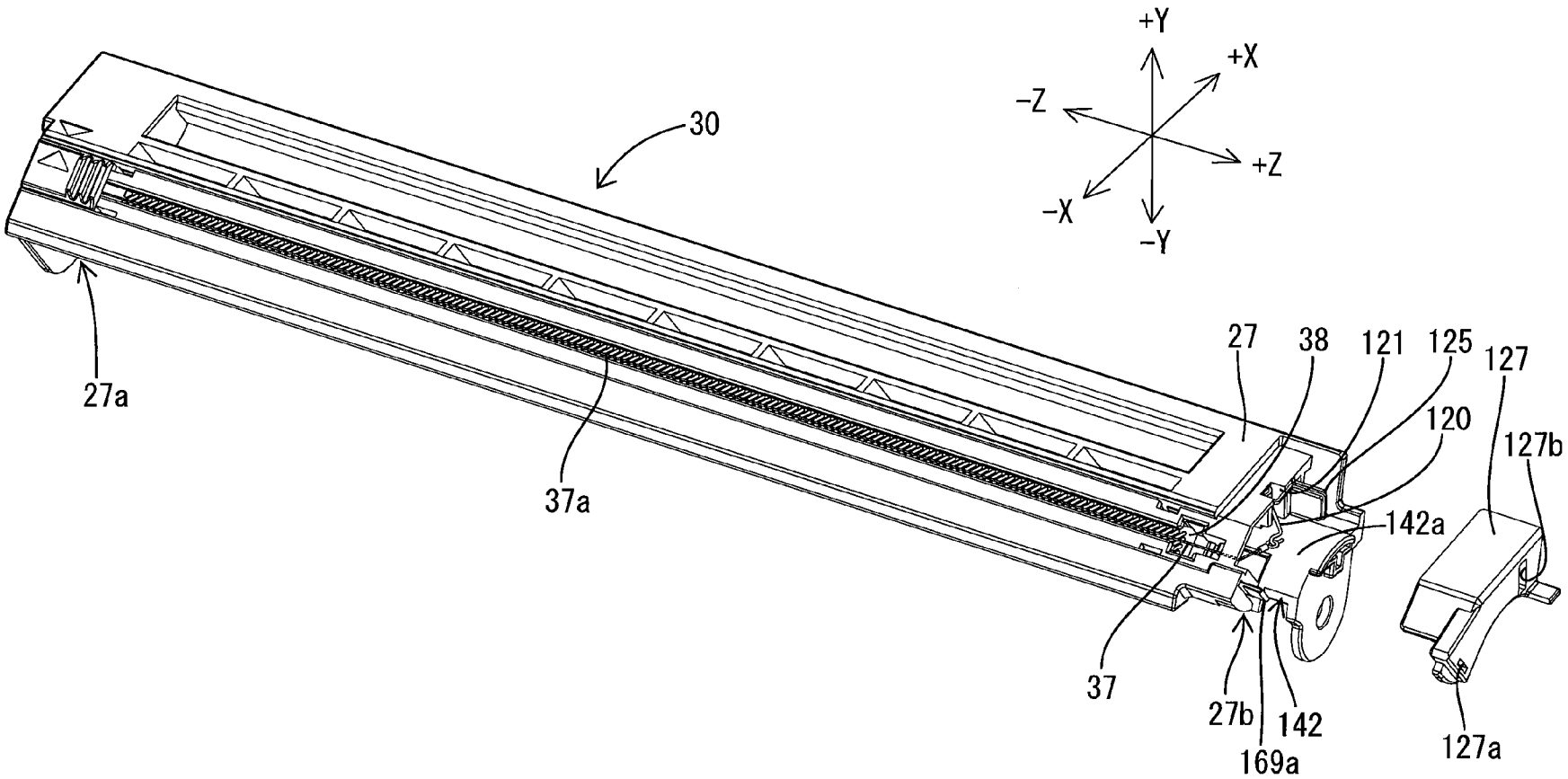
FIG. 6 is a perspective view of a charger viewed obliquely from behind.
Figure 7:
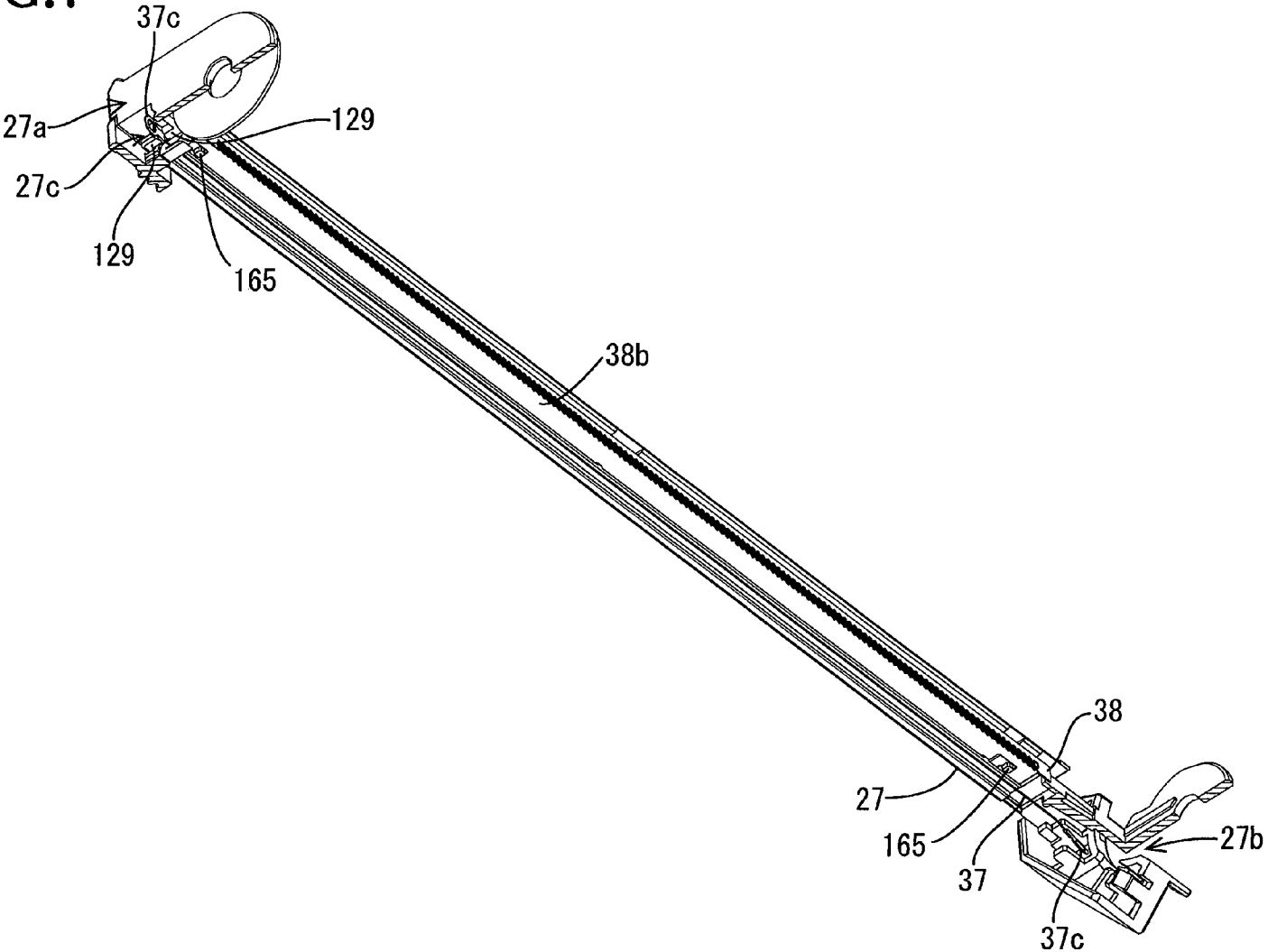
FIG. 7 is a perspective view of the charger partially omitted.
Figure 8A:
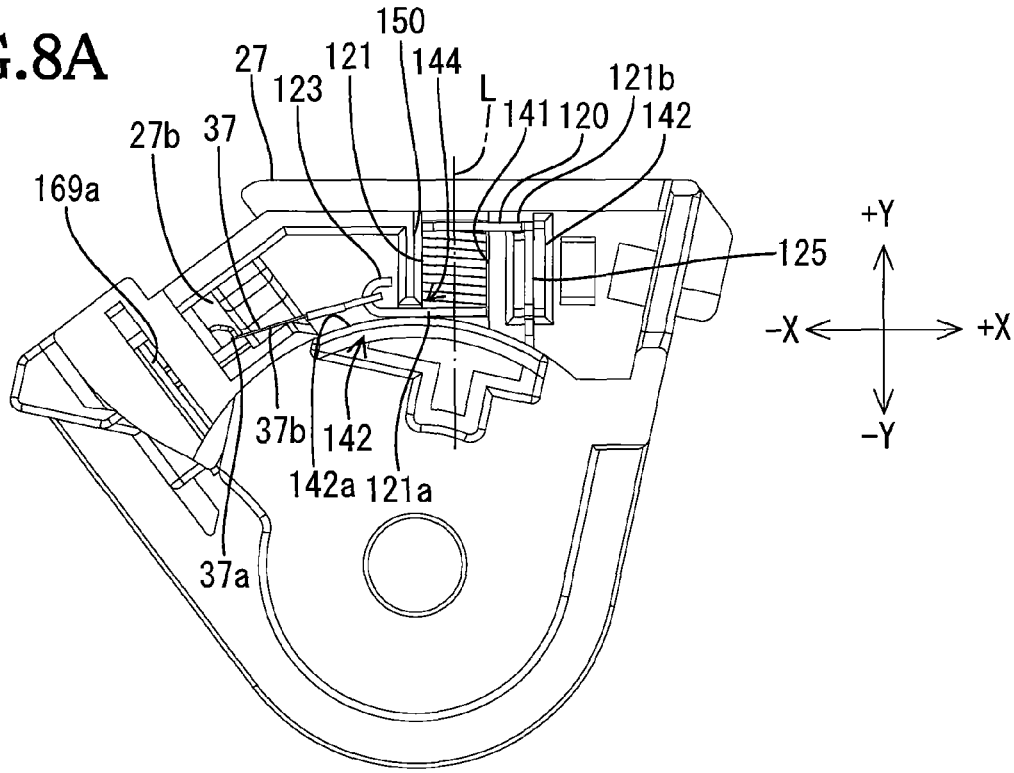
FIG. 8A is a side view of the charger without a cap when the charging wire is attached.
Figure 8B:
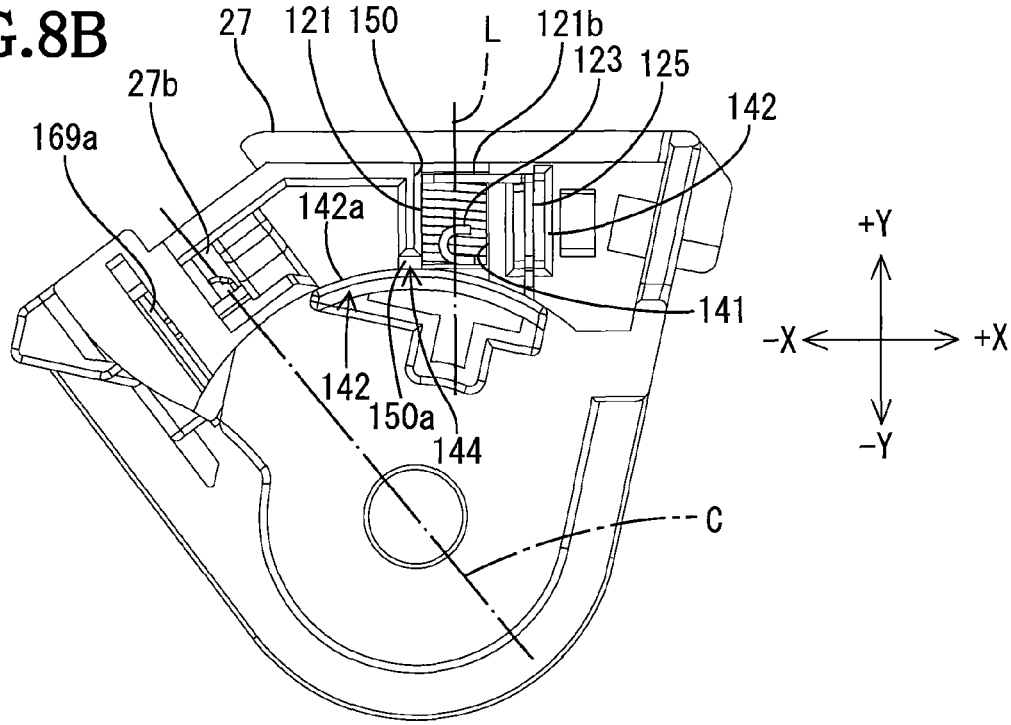
FIG. 8B is a side view of the charger without a cap when the charging wire is removed.
Figure 9:
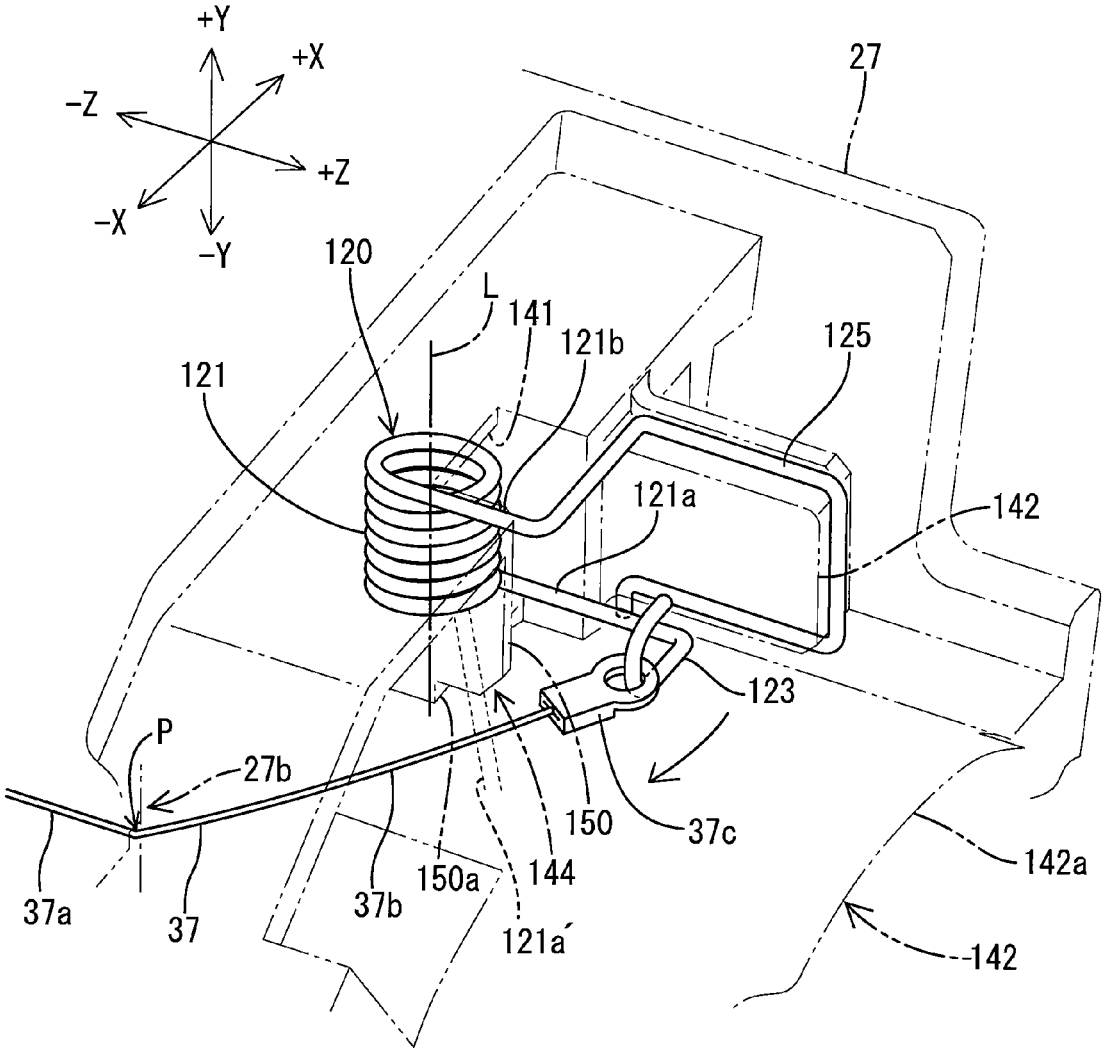
FIG. 9 is a view illustrating the charging wire being pulled by a wire pulling member.

FIG. 6 is a perspective view of the charger obliquely from behind. FIG. 7 is a cutaway view of the charger. FIG. 8A shows a side view of the charger when the cap is removed and the charging wire is provided, and FIG. 8B shows a side view of the charger when the cap is removed and the charging wire is removed. FIG. 9 shows that the charging wire is pulled by the wire pulling member. In the descriptions as to FIG. 6 or later, a longitudinal direction of the photosensitive drum 29 is referred to as a z-axis direction, a front-back direction of the image forming apparatus is referred to as an x-axis direction, and a height direction of the image forming apparatus is referred to as a y-axis direction.

As shown in FIG. 5, the charger 30 is as a scorotron charger, including the upper frame 27, and is provided in a manner that the charging wire 37 and the grid electrode 38 are attached to the upper frame 27. As shown in FIGS. 6 and 7, the upper frame 27 is provided with a pair of wire supporting walls 27*a*, 27*b* that support the charging wire 37 stretched therebetween. As shown in FIG. 7, the wire supporting wall 27*a* is provided with a stopper 27*c* (functioning as a stopper) at which one end of the charging wire 37 is caught. Engaged members 37*c*, each having a circular portion, are provided at both ends of the charging wire 37. The stopper 27*c* includes a pair of opposing portions 129 facing each other via a space that permits a wire portion to pass but the engaged member 37*c* not to pass.

As shown in FIG. 6, a wire pulling member 120 that pulls the charging wire 37 is attached to the upper frame 27. The wire pulling member 120 includes a coil spring portion 121 that is helically structured, and an engaging portion 123, as shown in FIGS. 8A, 8B and 9. The engaging portion 123 is provided at an end portion of the coil spring portion 121, and is capable of engaging with the engaged member 37*c*, which is provided at the other end of the charging wire 37 (an end opposite the stopper 27*c*).

As shown in FIGS. 8A, 8B and 9, the coil spring portion 121 includes a torsion spring configured such that arms 121*a*, 121*b*, which are end portions of the coil spring portion 121, can move relatively with respect to a coil centerline L. The coil spring portion 121 is configured such that the arm 121*b* is fixed at the upper frame 27 and the arm 121*a* is capable of moving around the coil centerline L. The arm 121*a* is capable of moving in a direction of an arrow shown in FIG. 9. When the arm 121*a* is moved in the direction of the arrow from a natural state, it generates urging force acting in a direction opposite to the direction of the arrow (that is, a direction where the charging wire 37 is pulled). When the charging wire 37 is attached, the engaged member 37*c* is caught at one end at the stopper 27*c* (FIG. 7), and the arm 121*a* is moved against the urging force in the direction of the arrow shown in FIG. 9 from the natural state shown in FIG. 8B (a state where the charging wire 37 is not attached and any urging force is not applied to the coil spring portion 121). Then, the engaged member 37*c* is engaged with the engaging portion 123 at the other end, so that the charging wire 37 is attached. After the charging wire 37 is attached, the arm 121*a* pulls the wire 37 with the result that the charging wire 37 is stretched taut as shown in FIGS. 6, 8A and 9.

As shown in FIGS. 8A, 8B and 9, the wire pulling member 120 is held by the upper frame 27 in a condition that the coil spring centerline L is substantially perpendicular to a longitudinal direction of an extended portion 37*a* of the charging wire 37 provided between the wire supporting walls 27*a*, 27*b* (FIG. 6). The longitudinal direction of the extended portion 37*a* is substantially parallel to the longitudinal direction (a z-axis direction of FIG. 9) of the photosensitive drum 29 (FIG. 5). As shown in FIGS. 8A, 8B and 9, the charging wire 37 has a distal portion 37*b* that extends from the wire supporting wall 27*b* to the engaging portion 123 of the wire pulling member 120, and the extended portion 37*a* is provided so as to extend from the end portion of the distal portion 37*b* along the longitudinal direction (the z-axis direction of FIG. 9 or a direction perpendicular to the sheet of FIGS. 8A and 8B) of the photosensitive drum 29.

Conventionally, a charging wire is laid along the wall surface of the wire supporting wall and bent at substantially right angles from a supporting portion of the wire supporting wall. This sharp bend causes the charging wire great stress, which may lead to problems such as that the charging wire breaks. If the charging wire is stretched taut in the longitudinal direction, a coil spring portion may be arranged so that a coil centerline is substantially parallel to the longitudinal direction. However, with this arrangement, the coil spring portion may protrude greatly in the longitudinal direction. To stretch the charging wire at a stable tension, the number of turns of the coil spring portion should be increased, and the coil spring portion may protrude further greatly in the longitudinal direction, inevitably leading to increasing the size of the printer.

However, in this illustrative embodiment, the coil spring portion 121 is unlikely to protrude in the longitudinal direction and the charging wire 37 is stretched taut at a stable tension, which will lead to size reduction of the laser printer 1.

As shown in FIGS. 8A, 8B and 9, the upper frame 27 is provided with an opposing surface 142*a* that faces the distal portion 37*b* along therewith. Specifically, a wire facing portion 142 is provided at an end portion of the upper frame 27 further outward than the wire supporting wall 27*b* so as to face the distal portion 37*b* along therewith, and the opposing surface 142*a* is configured as an outer surface of the wire opposing portion 142.

Accordingly, the distal portion 37*b* of the charging wire 37 can be covered by the opposing surface 142*a*. As a result, the charging wire 37 can be prevented from breaking, for example, during maintenance, when something snags on the charging wire 37.

In addition, the upper frame 27 is provided with a range control portion 144 that regulates a movable range of the engaging portion 123. The range control portion 144 is configured by a wall portion 150 that protrudes in a rib-like form in the longitudinal direction (the z-axis direction). At the front end of the wall portion 150, there is a space that allows the passage of the arm 121*a* between the edge of the wall portion 150 and the opposing surface 142*a*. At the proximal end of the wall portion 150, a space is not provided, and a proximal end portion 150*a* having an outer surface that is recessed from the front end surface (in a z-axis direction) is provided. When the arm 121*a* is about to rotate more than a specified range, the arm 121*a* contacts the proximal end portion 150*a* and its movable range is controlled, as conceptually shown by a broken line 121*a*'.

Accordingly, as this structure narrows the movement of the distal portion 37*b* of the charging wire 37 to be engaged with the engaging portion 123 to some extent, the charging wire 37 is prevented from coming off or breaking.

As shown in FIG. 9, the engaging portion 123 of the wire pulling member 120 is configured so as to be placed outward from a support position P by the wire supporting wall 27*b* (an end position of the distal portion 37*b*) in the longitudinal direction of the extended portion 37*a* (the z-axis direction).

Accordingly, it is possible to reduce a bending angle of the charging wire 37, which the extended portion 37*a* forms with the distal portion 37*b* laid outward from the wire supporting wall 27*b*, so that the charging wire 37 can be prevented from breaking.

As shown in FIGS. 8A, 8B and 9, the coil spring portion 121 is stored in a recessed portion 141 provided in the upper frame 27, and held in the recessed portion 141 with the inside of the coil spring portion 121 being hollow.

A conventional wire pulling member is positioned by inserting a shaft into the inside of the coil spring portion. With this structure, when the diameter of the coil spring portion is changed, constriction or looseness to the shaft may be likely to happen, leading to a fluctuation in a frictional force generated between the coil spring portion and the shaft. As a result, stable tension may not be applied to the charging wire or the coil spring portion may be out of position.

However, as the coil spring portion 121 is held with its inside being hollow in this illustrative embodiment, such problems which accompany the diameter change can be resolved effectively.

As shown in FIGS. 8A, 8B and 9, the wire pulling member 120 is provided with an electrode portion 125 for applying a voltage to the charging wire 37, at a portion extended from the end portion of the coil spring portion 120, which is opposite the engaging portion 123. Accordingly, the wire pulling member 120 can apply a stable tension and voltage to the charging wire 37 and can be simplified in structure. The end portion of the electrode portion 125 is engaged with a protrusion 142 and placed outward further than the end portion of the engaging portion 123 with respect to the longitudinal direction (the z-axis direction). With this structure, power supply to the charging wire 37 is facilitated and the movement of the engaging portion 120 is unlikely to be impeded.

(Grid Electrode)

Next, the grid electrode will be described.

Figure 10:
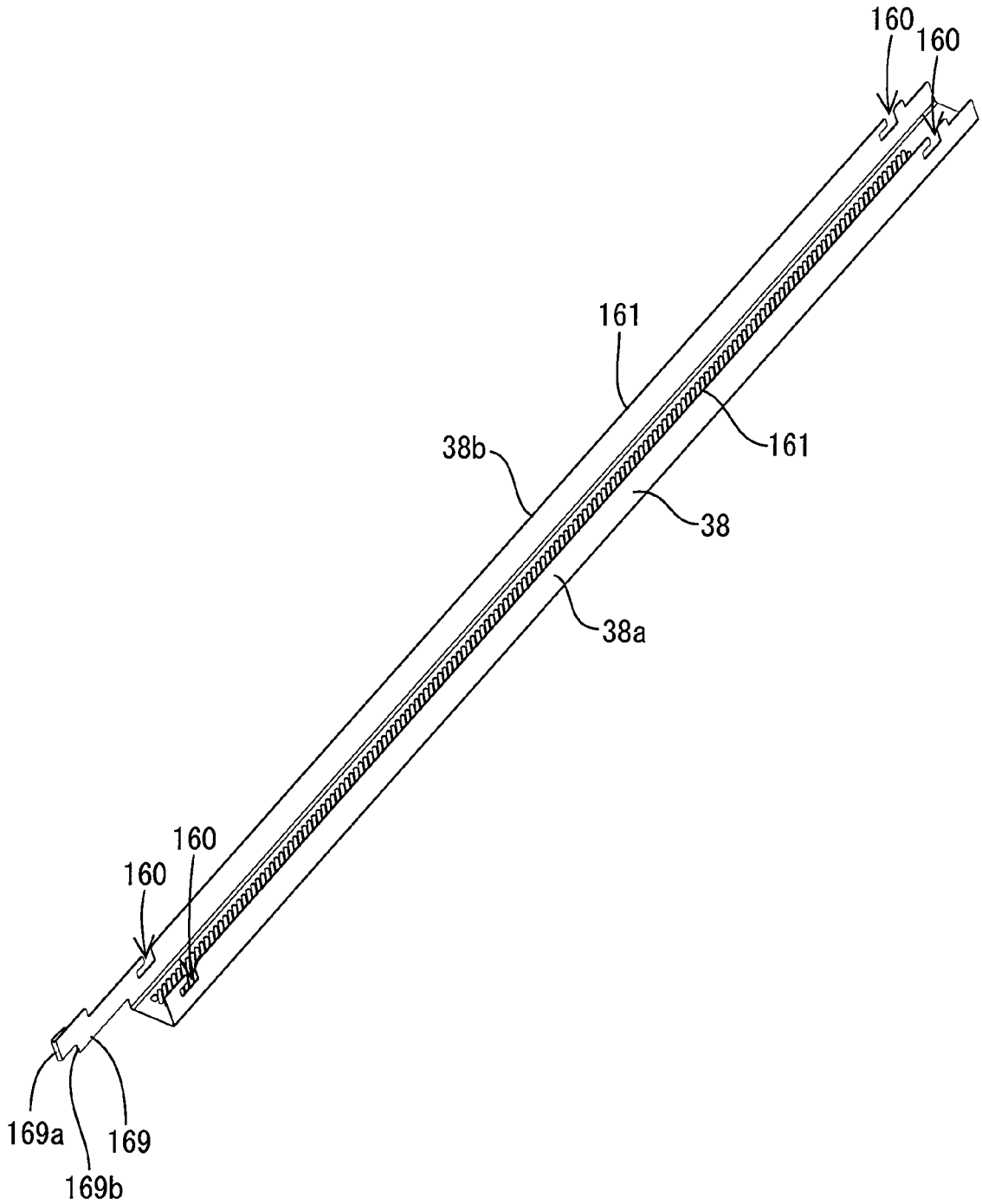
FIG. 10 is a perspective view of a grid electrode.
Figure 11A:
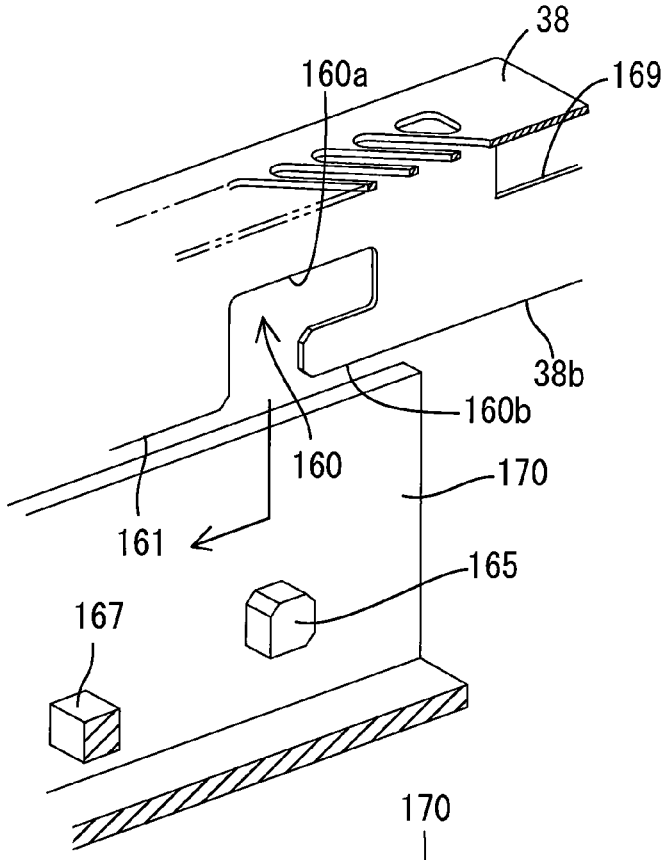
FIGS. 11A, 11B, and 11C illustrate movements of the bearing member shown in FIG. 4 when the grid electrode is attached to the upper frame.
Figure 11B:
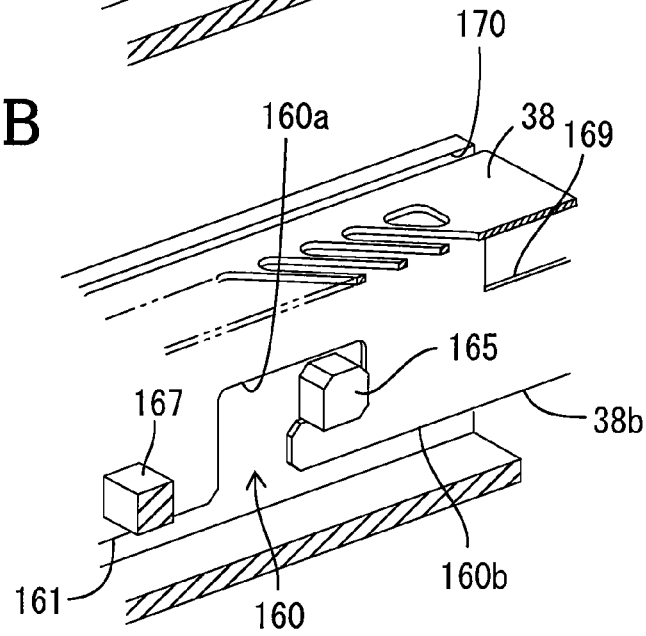
Figure 11C:
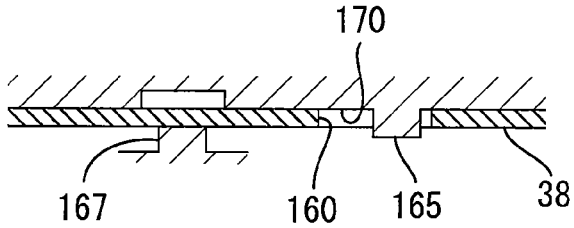

FIG. 10 is a perspective view showing the grid electrode, FIG. 11A is an enlarged view of essential parts of the charger and a perspective view showing a state before the grid electrode is assembled in the frame. FIG. 11B is a perspective view showing a state where the grid electrode is assembled in the frame after relative movement from a state shown in FIG. 11A. FIG. 11C is a cross sectional view, which is orthogonal to a wall surface of an opposing wall, showing a state shown in FIG. 11B, and a cross sectional view taken along the longitudinal direction (the z-axis direction), where a connected portion 165 and a tilt-preventing portions 167 are provided. The grid electrode 38 is interposed between the charging wire 37 and the photosensitive drum 29 as shown in FIG. 5, and is attached to the upper frame 27 as shown in FIG. 7. Specifically, as shown in FIG. 10, the grid electrode 38 is formed long and made of a conductive material such as a metallic material. The grid electrode 38 is shaped such that its section, orthogonal to the longitudinal direction, is formed in a substantially angular U-shape. The grid electrode 38 is provided with a pair of opposing walls 38*a*, 38*b*, which are plane parallel to each other along the longitudinal direction. As shown in FIGS. 5 and 7, the opposing walls 38*a*, 38*b* are supported by the upper frame 27. The charging wire 37 is extended between the opposing walls 38*a*, 38*b* along them. The charging wire 37 and each of the opposing walls 38*a*, 38*b* are spaced away at a substantially same distance.

As shown in FIG. 10, each of pair of opposing walls 38*a*, 38*b* in the grid electrode 38 is formed with connecting portions 160, which are comprised of a notch portion for connecting with the upper frame 27 (FIG. 7). The upper frame 27 shown in FIG. 7 is provided with connected portions 165 for engaging with the connecting portions 160. As shown in FIG. 11A, the connecting portion 160 includes an extending portion 160*b* that extends in the longitudinal direction (z-axis direction), and a guiding portion 160*a* that has a groove-like shape and guides the connected portion 165 in the longitudinal direction.

As shown in FIGS. 10 and 11A, the opposing walls 38*a*, 38*b* are formed with straight portions 161 at their edge portions extending in the longitudinal direction, and the connecting portions 160 are configured as notched portions from which a part of the straight portion 161 is cut in an L shape. Edge portions defining each notched portion are configured as the extending portion 160*b*.

The connecting portions 160 are configured as notched portions and thus formed simply and inexpensively. In addition, as there is no need to protrude the connecting portions 160 at the edge portions of the opposing walls 38*a*, 38*b*, the connecting portions 160 are unlikely to be deformed by bending.

For assembling the grid electrode 38 in the upper frame 27, the connected portion 165 is relatively moved in the connecting portion 160 from the state shown in FIG. 11A, the grid electrode 38 is slid in the upper frame 27 in the longitudinal direction relatively. The connected portion 165 is guided by the guiding portion 160*a* formed in the connecting portion 160 in the longitudinal direction (the z-axis direction) and engaged with the connecting portion 160 as shown in FIG. 11C, and the grid electrode 38 and the upper frame 27 are connected to each other.

A conventional grid electrode is formed with holes for connection on its opposing walls. The holes are used for inserting engaging hooks that protrude from the frame. With this structure, when the grid electrode is assembled in the frame, the opposing walls of the grid electrode should be bent temporarily to engage the engaging hooks in the holes. Thus, assembling operation needs accuracy. If assembly is not performed with attention, the electrode may be permanently deformed, which may affect discharging performance of the electrode. This problem may be serious especially when the size of the electrode is reduced.

However, in this illustrative embodiment, the grid electrode 38 is configured to be assembled in the upper frame 27 by sliding the grid electrode 38 to engage the extending portion 160*b* provided in the connecting portion 160 with the connected portion 165. Thus, during assembly, the grid electrode 38 can be assembled into the upper frame 27 with little stress and the shape of the grid electrode 38 maintained.

Figure 12:
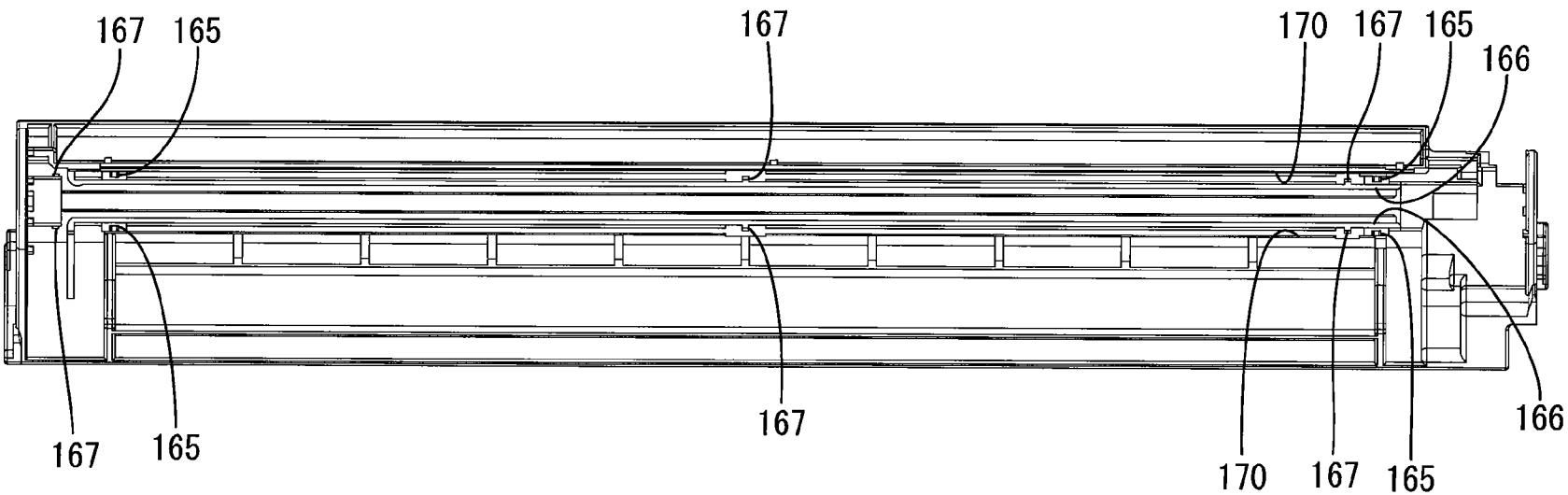
FIG. 12 shows an upper frame viewed from a bottom surface.

FIG. 12 shows the back side of the upper frame 27 where the grid electrode 38 is not mounted. As shown in FIGS. 11B, 11C, and 12, the upper frame 27 is formed with tilt-preventing portions 167 that are formed in protrusions to prevent the opposing walls 38*a*, 38*b* from tilting toward facing directions opposite each other. The tilt-preventing portions 167 are configured to protrude toward thickness of the opposing walls 38*a*, 38*b* (that is, in the facing directions). As shown in FIGS. 11B and 11C, in the condition where the grid electrode 38 is mounted to the upper frame 27, the end portions of the tilt-preventing portions 167 contact the inner surfaces of the opposing walls 38*a*, 38*b*, which prevent the opposing walls 38*a*, 38*b* from tilting inward (toward the facing directions). The tilt-preventing portions 167 effectively prevent deformation of the electrode 38. As shown in FIGS. 11B, 11C and 12, the outer surfaces of the opposing walls 38*a*, 38*b* are supported by the wall portions 170 formed in the upper frame 27, and configured so as not to tilt outward (toward directions opposite the facing directions).

In this illustrative embodiment, as shown in FIG. 10, there are two connecting portions 160 provided to each opposing wall 38*a*, 38*b*, and the connecting portions 160 are disposed at both ends of each opposing wall 38*a*, 38*b* with respect to their longitudinal direction.

To stably support the grid electrode, the grid electrode may be supported at two or more places at each opposing wall, at a total of four or more places. However, too many support places takes much times for checking, during assembly, whether the grid electrode is supported in the frame at each support place. In this illustrative embodiment, however, the grid electrode 38 can be stably supported in the frame 27 and assembly operation can be simply performed.

The grid electrode 38 is disposed facing the photosensitive drum 29 (FIG. 5) so that the longitudinal direction of the grid electrode 38 is substantially parallel to the longitudinal direction (the z-axis direction) of the photosensitive drum 29 (FIG. 5), while the connecting portions 160 are disposed outside the printing area of the photosensitive drum 29 (FIG. 5) in the longitudinal direction (the z-axis direction). Thus, this structure can prevent loss of image quality due to irregular discharging.

As shown in FIGS. 6 and 10, the grid electrode 38 is provided with a contact terminal 169*a* that contacts a power terminal (not shown) provided at an exterior of the process cartridge 20. The contact terminal 169*a* is disposed at an end of the grid electrode 38, which is opposite from where the grid electrode 38 is slid when assembled in the upper frame 27. Thus, when the power terminal and the contact terminal 169*a* are brought into contact with each other, the grid electrode 38 can be prevented from falling out. In other words, when the power terminal and the contact terminal 169*a* contact each other, the grid electrode 38 is constantly pressed in the direction it is slid during assembly operation, and thus the grid electrode 38 is structurally held in the upper frame 27 stably.

On the other hand, a cap 127 is provided so as to cover a side of the charger 30 where the wire pulling member 120 is provided, and the cap 127 includes holes 127*a*, 127*b* for inserting the electrode portion 125 and the contact terminal 169*a*, respectively. With the cap 127 attached to the upper frame 27, the electrode portion 125 and the contact terminal 169*a* are exposed from the process cartridge 20 (FIG. 4).

The cap 127 functions as a moving control member, and controls the grid electrode 38 so as not to move in a direction opposite to the direction that the grid electrode 38 is slid when assembled in the upper frame 27. With this structure, the grid electrode 38 can be prevented from being disengaged. Specifically, the cap 127 is configured such that the hole 127*a* shown in FIG. 6 allows the contact terminal 169*a* only to pass therethrough and does not allow a stepped portion 169*b* (FIG. 10) to pass therethrough (the hole 127*a* is smaller than the stepped portion 169*b*). With the cap 127 attached to the upper frame 27, the grid electrode 38 cannot be slid toward the contact terminal 169*a* relatively with respect to the upper frame 27. As is clear from FIG. 11B, the connecting portion 160 and the connected portion 165 are not disengaged if the grid electrode 38 cannot be slid toward the contact terminal 169*a*. Thus, the grid electrode 38 is stably fixed to the upper frame 27 as long as the cap 127 is removed.

The connecting portion 160 includes the notched portion in the above illustrative embodiment, however, it may be configured in any shape such as an L-shaped protrusion as long as it is capable of engaging with the connected portion.

Figure 13A:
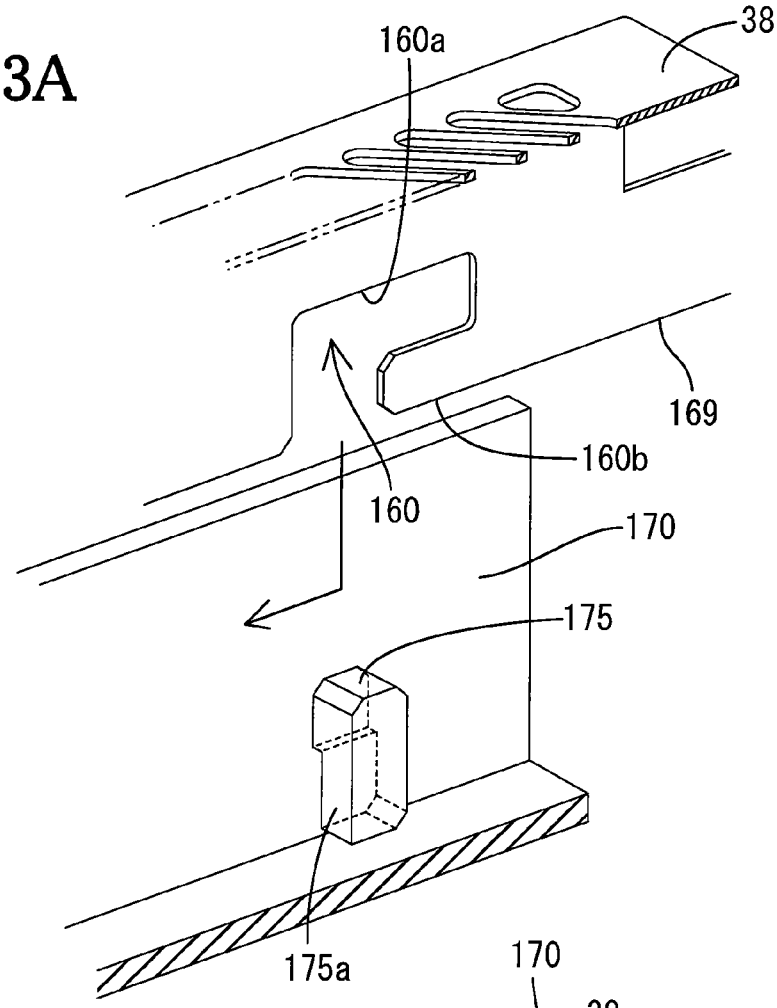
FIGS. 13A and 13B show another example of a connected portion and a tilt-preventing portion.
Figure 13B:
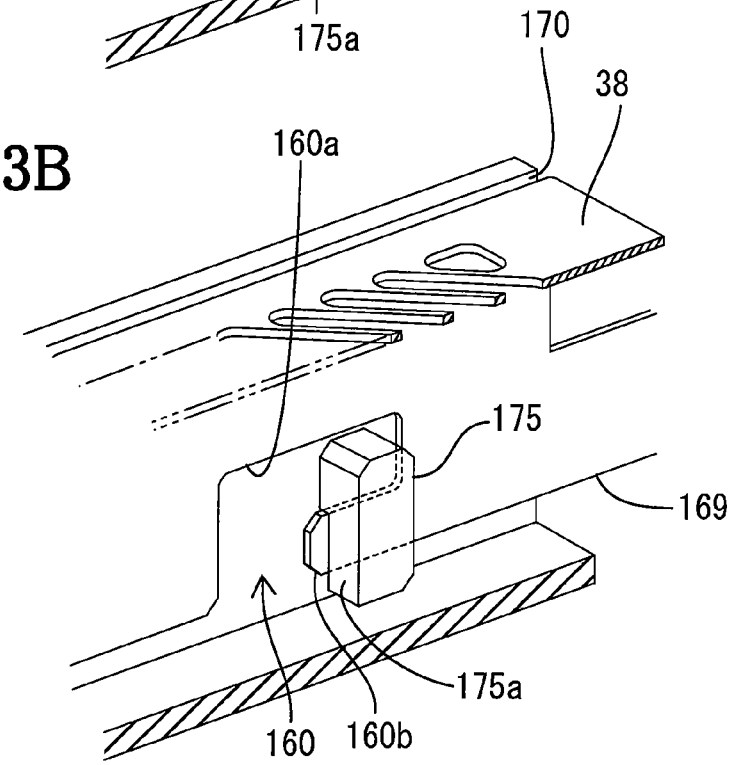

In the above illustrative embodiment, the tilt-preventing portion 167 and the connected portion 165 are formed at different positions. However, as shown in FIGS. 13A and 13B, a tilt-preventing portion and a connected portion may be formed integrally. In FIGS. 13A and 13B, a connected portion 175 protrudes toward thickness of the opposing wall 38*a*, 38*b*, and bends so as to intersect with the extending portion 160*b*. There is a clearance between an end portion 175*a* of the connected portion 175 and a wall surface of a wall portion 170, which is substantially equal to the thickness of the extending portion 160*b*. As shown in FIG. 13B, the connecting portion 160 and the connected portion 175 are connected, so that the opposing wall 38*a*, 38*b* can be prevented from tilting. In this structure, the connected portion 175 functions as a tilt-preventing portion.

While this invention has been described in conjunction with the exemplary embodiments outlined above, various alternatives, modifications, variations, improvements and/or substantial equivalents, whether known or may be presently unforeseen, may become apparent to those having at least ordinary skill in the art. Accordingly, the exemplary embodiments of the invention, as set forth above, are intended to be illustrative, not limiting. Various changes may be made without departing from the spirit and scope of the invention. Therefore, the invention is intended to embrace all known or later developed alternatives, modifications, variations, improvements and/or substantial equivalents.

What is claimed is:

1. A process cartridge detachably attachable to a main body of an image forming apparatus, the process cartridge comprising:

a photosensitive member;

a charging device configured to charge the photosensitive member, the charging device comprising:

a conductive grid electrode that is configured in an angular U-shape as viewed from a cross section perpendicular to a longitudinal direction thereof, the grid electrode having a pair of opposing walls extending along the longitudinal direction;

a frame holding the grid electrode by supporting each of the opposing walls of the grid electrode; and a charging wire attached to the frame and extended between the opposing walls of the grid electrode parallel to the opposing walls, wherein each of the opposing walls of the grid electrode is provided with a connecting portion having an extending portion that extends in the longitudinal direction and including either a protrusion or a notched portion, the frame is provided with a connected portion configured to engage with the connecting portion, and during assembling of the grid electrode to the frame, the grid electrode is slid in the frame relatively in the longitudinal direction, the extending portion provided in the connecting portion engages with the engaged portion, and the grid electrode and the frame are connected to each other; and a moving control member configured to control the grid electrode to restrict movement in a direction opposite to a direction that the grid electrode is slid in the frame when the grid electrode is mounted in the frame.

2. The process cartridge according to claim 1, wherein a straight portion that extends in a straight line is formed at an edge portion of each of the opposing walls that extends in the longitudinal direction, the connecting portion includes a notched portion from which a part of the straight portion is cut in an L shape, and an edge portion of the notched portion is configured as the extending portion.

3. The process cartridge according to claim 1, wherein the frame is formed with a tilt-preventing portion configured to prevent the opposing walls from tilting toward facing directions opposite each other.

4. The process cartridge according to claim 1, wherein the connecting portion comprises two connecting portions at each of the opposing walls, the connecting portions being disposed at both ends of each of the opposing walls with respect to the longitudinal direction.

5. The process cartridge according to claim 1, wherein the connecting portion is disposed outside a printing area with respect to the longitudinal direction.

6. The process cartridge according to claim 1, wherein the grid electrode has a contact terminal configured to contact a power terminal provided at an exterior of the process cartridge, and the contact terminal is disposed at an end portion of the grid electrode, which is opposite from where the grid electrode is slid when the grid electrode is assembled to the frame.

7. A process cartridge detachably attachable to a main body of an image forming apparatus, the process cartridge comprising:

a photosensitive drum; and a charging device configured to charge the photosensitive member, the charging device comprising:

a conductive grid electrode that is configured in an angular U-shape as viewed from a cross section perpendicular to a longitudinal direction thereof, the grid electrode having a pair of opposing walls extending along the longitudinal direction;

a frame holding the grid electrode by supporting each of the opposing walls of the grid electrode; and a charging wire attached to the frame and extended between the opposing walls of the grid electrode parallel to the opposing walls, wherein each of the opposing walls of the grid electrode is formed with a connecting portion configured to connect with the frame, the frame is provided with a connected portion configured to engage with the connecting portion, one of the connecting portion and the connected portion is formed with a guiding portion that guides the other one of the connecting portion and the connected portion in the longitudinal direction, and during assembling of the grid electrode to the frame, the grid electrode is slid in the frame relatively in the longitudinal direction, one of the connecting portion and the connected portion is guided by the guiding portion formed in the other one of the connecting portion and the connected portion in the longitudinal direction in engagement with each other, and the grid electrode and the frame are connected to each other; and a moving control member configured to control the grid electrode to restrict movement in a direction opposite to a direction that the grid electrode is slid in the frame when the grid electrode is mounted in the frame.

8. The process cartridge according to claim 7, wherein the frame is formed with a tilt-preventing portion configured to prevent the opposing walls from tilting toward facing directions opposite each other.

9. The process cartridge according to claim 7, wherein the connecting portion comprises two connecting portions at each of the opposing walls, the connecting portions being disposed at both ends of each of the opposing walls with respect to the longitudinal direction.

10. The process cartridge according to claim 7, wherein the connecting portion is disposed outside a printing area with respect to the longitudinal direction.

11. The process cartridge according to claim 7, wherein the grid electrode has a contact terminal configured to contact a power terminal provided at an exterior of the process cartridge, and the contact terminal is disposed at an end portion of the grid electrode, which is opposite from where the grid electrode is slid when the grid electrode is assembled to the frame.

12. The process cartridge according to claim 7, wherein an imaginary line extending from one opposing wall to the other opposing wall passes through the charging wire.

13. The process cartridge according to claim 1, wherein an imaginary line extending from one opposing wall to the other opposing wall passes through the charging wire.

* * * * *